United States Patent [19]

Fraser et al.

[11] 4,034,709

[45] July 12, 1977

[54] DEVELOPER ROLL

[75] Inventors: Lawrence J. Fraser, Rochester; Delmer G. Parker, Irondequoit; Joseph L. Scaletta, Henrietta, all of N.Y.

[73] Assignee: Xerox Corporation, Stamford, Conn.

[21] Appl. No.: 625,435

[22] Filed: Oct. 22, 1975

[51] Int. Cl.[2] ..... G03G 13/06

[52] U.S. Cl. ..... 118/658; 355/3 DD

[58] Field of Search ..... 118/637, 645, 653, 656, 118/657, 658; 355/3 R, 3 DD; 427/21

[56] References Cited

U.S. PATENT DOCUMENTS

| | | | |
|---|---|---|---|
| 3,863,603 | 2/1975 | Buckley et al. | 118/637 |
| 3,909,258 | 9/1975 | Kotz | 118/637 |

*Primary Examiner*—Henry S. Jaudon

*Attorney, Agent, or Firm*—J. J. Ralabate; H. Fleischer; C. A. Green

[57] ABSTRACT

An apparatus which renders a latent image visible by depositing developer material thereon. The apparatus includes a tubular member having a styrene-butadiene layer coated on a nonmagnetic roll. Magnets are disposed interiorly of the tubular member to attract the developer material thereto. The developer material is transported into contact with the latent image to produce a powder image thereon.

14 Claims, 3 Drawing Figures

DEVELOPER ROLL

The foregoing abstract is neither intended to define the invention disclosed in the specification, nor is it intended to be limiting as to the scope of the invention in any way.

BACKGROUND OF THE INVENTION

This invention relates to an electrostatographic printing machine, and more particularly concerns an improved development system for use therein. In the process of electrostatographic printing, electrostatic latent charge patterns are formed on an insulating medium for the purpose of recording and reproducing the patterns in viewable form.

The field of electrostatographic printing includes both electrographic and electrophotographic printing. Electrophotographic printing employs a photosensitive medium to form, with the aid of electromagnetic radiation, an electrostatic latent charge pattern thereon. Electrographic printing utilizes an insulating medium to form, without the aid of electromagnetic radiation, an electrostatic latent charge pattern. Development, which is the act of rendering an electrostatic pattern or image viewable, is employed in all of the aforementioned types of electrostatographic printing. An electrophotographic printing machine is described hereinafter as an illustrative embodiment of this process.

Electrophotographic printing charges a photoconductive surface to a substantially uniform potential to sensitize the surface. The charged photoconductive surface is, thereafter, exposed to a light image of the original document being reproduced. As a consequence of this exposure, the charge on the photoconductive surface is selectively dissipated in accordance with the light intensity reaching the surface. This creates an electrostatic latent image on the photoconductive surface corresponding to the original document.

Development of the electrostatic latent image recorded on the photoconductive surface is achieved by bringing a developer mix into contact therewith. Typical developer mixes employed in the art generally comprise dyed or color thermoplastic powders, known as toner particles, which are mixed with coarser carrier granules, such as ferromagnetic granules. The toner particles and carrier granules are selected such that the toner particles have the appropriate charge relative to the electrostatic latent image recorded on the photoconductive surface. When the developer mix is brought into contact with the charged photoconductive surface, the greater attractive force of the electrostatic latent image causes the particles to transfer from the carrier granules and adhere to the latent image. This concept was originally disclosed by Carlson in U.S. Pat. No. 2,297,691 and is further amplified and described by many related patents in the art.

Many factors influence the quality of the developed image, the most significant factor being the uniformity with which the toner particles are deposited on the latent image. Heretofore, development systems have employed rotary impellers, fur brushes, bucket conveyors and magnetic brush systems to achieve the requisite uniformity in toner deposition. Magnetic brush systems achieve a high degree of uniform toner deposition, and are, therefore, used in numerous printing machines. In a magnetic brush system, a developer roll has a directional flux field which assists in bringing the magnetizable developer mix into contact with the latent image. The magnetic field causes the developer mix to form chain-like arrays similar to bristles of a brush. This brush of developer mix moves the latent image transferring toner particles from the carrier granules thereto. Thus, the developer roll serves to transport the developer mix from a sump in a housing to the latent image to render the latter visible. Various types of magnetic brush rolls have been developed. Exemplary of these is U.S. Pat. No. 3,040,704 issued to Bliss which describes a magnetic brush roll having a roughened exterior surface so as to facilitate the transportation of the developer mix. Many techniques have been employed to roughen the exterior surface of the developer roll. An example of one approach is disclosed in U.S. Pat. No. 3,246,629 issued to Shelffo. In this patent a flame spray is used to provide layer of irregular shaped particles which adhere to the exterior circumferential surface of the developer roll providing a randomly roughened surface. Other techniques for increasing the coupling between the developer roll and developer mix so as to improve the conveying function may be roughening the surface by knurling, shot peening, or by adhesively placing beads on sand on the outer surface. However, it is possible that this type of rough, abrasive surface does considerable mechanical damage to the developer mix at points where there is a speed mismatch between the roller and the developer mix. For example, at the feed or transfer point between the rollers and the developer mix or where the developer mix passes through a restricted orifice such as a metering blade or development point, the developer mix tends to wear. In addition, it has been found that the developer roller tends to become somewhat smoother with prolonged use. Thus, not only does the developer mix wear but the developer roller wears producing a shorter life for both the developer mix and developer roll. Moreover, the roundness of the developer roll is a critical tolerance. If the developer roll is not round, a strobing effect can be produced on the resultant copy. Thus, the roundness of the developer roll must be maintained within tolerance at all times.

Other approaches have been developed for providing a developer roll which does not induce wear on the developer mix while still having sufficient life. An example of this is described in U.S. Pat. No. 3,863,603 issued to Buckley et al.. A magnetic brush roller is described therein as having a resilient, roughened polyurethane coated on a metal tube. Similarly, U.S. Pat. No. 3,176,652 issued to Mott describes a magnetic brush apparatus having an elongated magnet held stationarily in a rotating shield. The shield may be plastic with the outer surface thereof roughened in a random or rectangular pattern. Finally, U.S. Pat. No. 3,563,734 issued to Shely discloses a developer powder applicator made from a roller coated with a conductive rubber or hardened conductive gelatin. The roller may be rotatable, hollow non-magnetic metal cylinder containing a stationary permanent magnet therein.

In experimentation, it has been found that a urethane coating may lack sufficient wear life to be suitable for use in an electrophotographic printing machine. Thus, the urethane coating may become smooth and slippery after several thousand copies have been made. For example, it has been found that the coefficient of friction off a urethane coating may change from 0.83 to 0.38 after three thousand copies. This is primarily due to the retention of toner particles in the urethane coating and the wear thereof.

Accordingly, it is the primary object of the present invention to improve the developer roll of a development system employed in an electrophotographic printing machine.

BRIEF SUMMARY OF THE INVENTION

Briefly stated, and in accordance with the present invention, there is provided an apparatus for depositing a developer material on a surface having a latent image recorded thereon.

Pursuant to the features of the present invention, the apparatus includes a tubular member comprising a hollow, substantially non-magnetic roll with a layer of styrene-butadiene having conductive particles dispersed therethrough coated on the exterior circumferential surface thereof. The layer of styrene-butadiene coated on the roll has a surface finish at least of a magnitude significant to transport the developer material to the latent image. Magnetic means is disposed within the roll of the tubular member. In this manner, the magnetic means creates a magnetic field about at least a portion of the periphery of the tubular member to attract magnetically the developer material to the styrene-butadiene layer on the roll.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
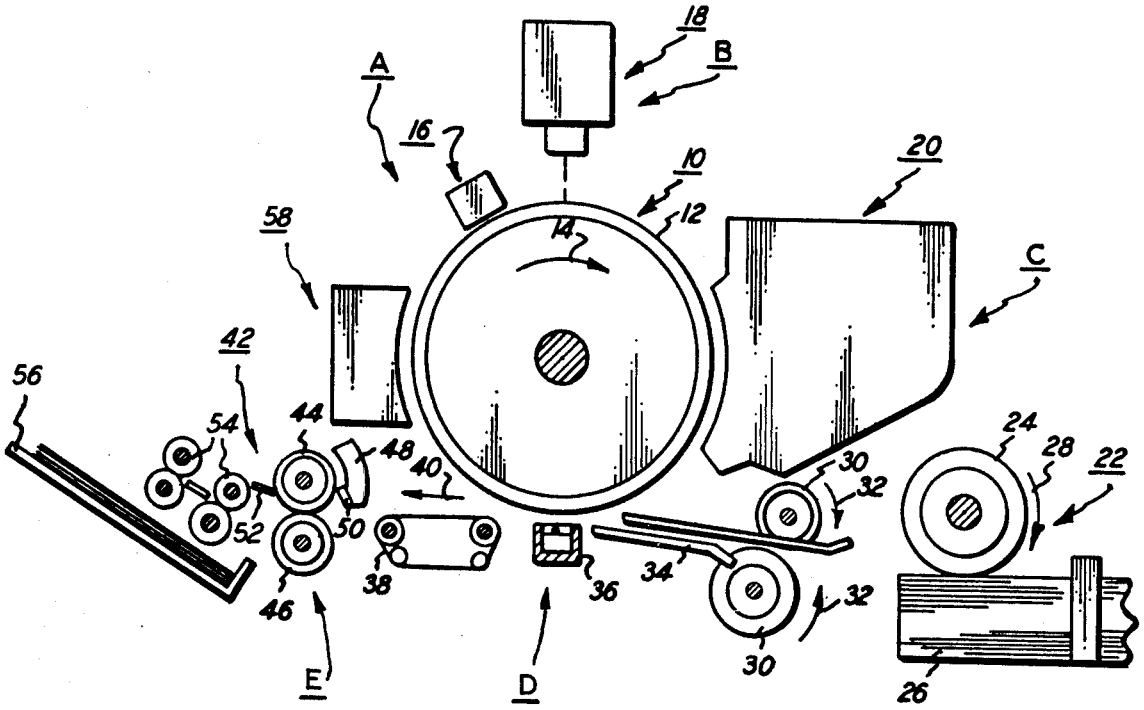
FIG. 1 is a schematic perspective view of an electrophotographic printing machine embodying the features of the present invention therein.

For a general understanding of an electrophotographic printing machine having the features of the present invention incorporated therein, reference is had to FIG. 1 which depicts schematically the various components thereof. In the drawings, like reference numerals have been employed throughout to designate identical elements. Although the development system of the present invention is particularly well adapted for use in the FIG. 1 electrophotographic printing machine, it will become evident from the following discussion that it is equally well suited for use in a wide variety of electrostatographic printing machines and is not necessarily limited in its application to the particular embodiment shown herein.

Inasmuch as the practice of electrophotographic printing is well known in the art, the various processing stations for producing a copy of an original document are represented in FIG. 1 schematically by the reference letters A through F, inclusive.

An electrophotographic printing machine employs a drum 10 having a photoconductive surface 12 entrained about and secured to the exterior circumferential surface thereof. Drum 10 is rotated in the direction of arrow 14 to pass through the various processing stations disposed about its periphery. A suitable photoconductive material may be a selenium alloy of the type described in U.S. Pat. No. 2,970,906 issued to Bixby in 1961.

Drum 10 initially rotates photoconductive surface 12 through charging station A. A corona generating device, indicated generally by the reference numeral 16, is positioned at charging station A. Corona generating device 16 is located closely adjacent to photoconductive surface 12. When energized, corona generating device 16 charges a portion of photoconductive surface 12 to a relatively high substantially uniform potential. One type of suitable corona generating device is described in U.S. Pat. No. 2,836,725 issued to Vyverberg in 1958.

The charged portion of photoconductive surface 12 is next rotated to exposure station B. Exposure station B includes an exposure mechanism, indicated generally by the reference numeral 18. Exposure mechanism 18 includes a stationary housing comprising a transparent platen, such as glass plate or the like, having the original document disposed thereon. Lamps illuminate the original document. Scanning of the original document may be achieved by oscillating a mirror in a timed relationship with the movement of drum 10, or by translating the lamp and lens system across the original document to create successive incremental light images thereof. The light images are projected, in a timed relationship, onto the charged portion of photoconductive surface 12. Thus, the light image of the original document is reflected through the lens onto a mirror which, in turn, transmits the light image through a slit onto the charged portion of photoconductive surface 12. Irradiation of the charged photoconductive surface selectively dissipates the charge thereon recording an electrostatic latent image corresponding to the orignal document.

After the electrostatic image is recorded on photoconductive surface 12, drum 10 rotates to development station C. At development station C, a development unit 20 brings the developer mix of carrier granules and toner particles into contact with the electrostatic latent image. The development unit is of a type hereinbefore referred to as a magnetic brush development system. In a magnetic brush development system, a magnetizable developer mix having carrier granules and toner particles is continually brought through a directional flux field to form a brush of developer material. The developer mix is continually moving to provide fresh developer mix to the brush. Preferably, the brush, in the magnetic brush system, comprises a magnetic member with a mass of developer material adhering thereto by magnetic attraction. The developer mix includes carrier granules having toner particles clinging thereto by triboelectric attraction. This chain-like arrangement of developer mix simulates the fibers of a brush. Development is achieved by bringing the brush of developer mix into contact with the latent image recorded on photoconductive surface 12. Developer unit 20 will be described hereinafter in greater detail with reference to FIGS. 2 and 3.

Referring now briefly to the sheet feeding path, the sheet of support material is advanced by sheet feeding apparatus 22 to transfer station D. Sheet feeding apparatus 22 includes feed roll 24 in contact with the uppermost sheet of the stack 26 of sheets. Feed roll 24 rotates in the direction of arrow 28 advancing successive uppermost sheets from stack 26. Registration rolls 30, rotating in the direction of arrow 32, align and forward the advancing sheet into chute 34. Chute 34 directs the sheet into contact with the photoconductive surface 12 in registration with the tone powder image formed thereon. Thus, the sheet of support material contacts the toner powder image at transfer station D.

A corona generating device, indicated generally by the reference numeral 36, is positioned at transfer station D. Corona generating device 36 applies a spray of ions onto the backside of the sheet of support material opposed from photoconductive surface 12. The toner powder image adhering to photoconductive surface 12 is attracted from the latent image to the sheet of support material. After transferring the toner powder image to the sheet of support material, endless belt conveyor 38 advances the sheet of support material in the direction of arrow 40 to fixing station E.

Fixing station E includes a fuser assembly indicated generally by the reference numeral 42. Fuser assembly 42 heats the transferred toner powder image to permanently affix it to the sheet of support material. A heated fuser roll 44 cooperates with a backup roll 46 to define a nip through which the sheet of support material passes. The sheet of support material passes through the nip with toner powder image thereon contacting fuser roll 44. Dispenser 48 periodically applies a release material, e.g. polyethylene, to fuser roll 44. Blade 50 adjusts the thickness of the release material coating fuser roll 44. After the toner powder image is permanently affixed to the sheet of support material, stripper blade 52 insures that the sheet is separated from fuser roll 44. The sheet of support material is then advanced by a series of rollers 54 to catch tray 56 for subsequent removal therefrom by the machine operator.

Invariably, after the sheet of support material is separated from photoconductive surface 12, some residual toner particles adhere to surface 12. These residual particles are removed from surface 12 at cleaning station F. Cleaning station F includes a cleaning mechanism, designated generally by the reference numeral 58. Cleaning mechanism 58 has a corona generating device and a brush contacting photoconductive surface 12. Initially, toner particles are brought under the influence of the corona generating device to neutralize the remaining electrostatic charge on photoconductive surface 12 and that of the residual toner particles. The neutralized toner particles are then cleaned from photoconductive surface 12 by a rotatably mounted fibrous brush. After the cleaning process, a discharge lamp floods photoconductive surface 12 with light to dissipate any residual charge thereon. In this way, the charge on photoconductive surface 12 is returned to its initial level prior to the recharging thereof.

It is believed that the foregoing description is sufficient for purposes of the present application to illustrate the general operation of an electrophotographic printing machine embodying the features of the present invention therein.

Figure 3:
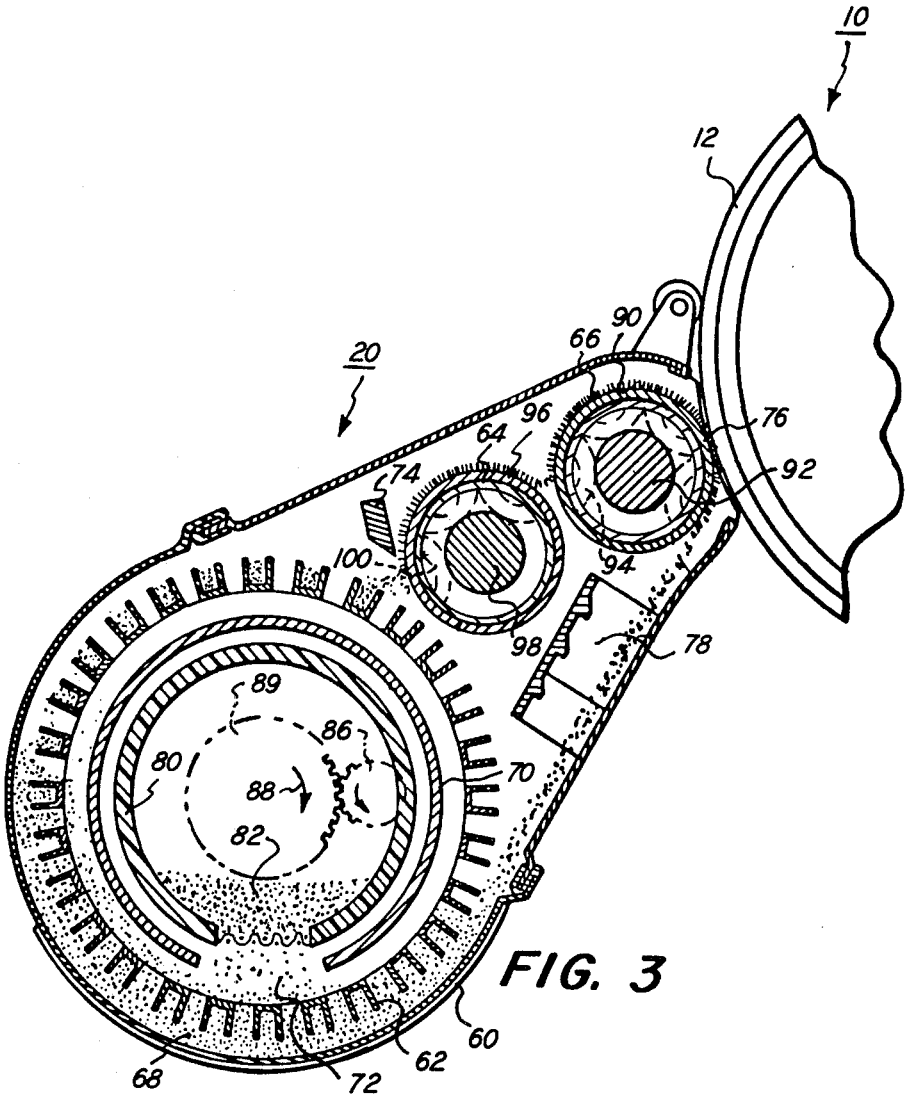
FIG. 3 is a fragmentary perspective view of a portion of the tubular member employed in the FIG. 2 development apparatus.

Referring now to the specific subject matter of the present invention, FIG. 3 depicts development unit 20 in greater detail.

The principle components of developer unit 20 are developer housing 60, advancing means or paddle wheel 62, transport roll 64, and developer roll 66. Paddle wheel 62 is a cylindrical member with buckets or scoops around the periphery thereof. As paddle wheel 62 rotates, it elevates developer mix 68 from the lower region of housing 60 to the upper region thereof. When developer mix 68 reaches the upper region of housing 60, it is lifted from paddle wheel buckets to transport roll 64. Alternate buckets of the paddle wheel have apertures in the root diameter and developer mix carried in these areas falls back to the lower region of developer housing 60. As the developer mix falls back to the lower region of developer housing 60, it cascades over shroud 70 which is of a tubular configuration with an aperture 72 in the lower region thereof. Developer mix 68 is recirculated in this manner so that the carrier granules are continually agitated to mix with fresh toner particles. This generates a strong triboelectric charge between the carrier granules and toner particles. As developer mix 68, in the paddle wheel buckets, approaches transport roll 64, the magnetic field produced by the fixed magnets therein attract developer mix 68 thereto. Transport roll 64 moves developer mix 68 in an upwardly direction by the frictional force exerted between the roll surface and developer mix. A surplus of developer mix 68 is furnished and metering blade 74 is provided to control the amount of developer mix 68 carried over the top of transport roll 64. The surplus developer mix 68 is sheared from transport roll 64 and falls in a downwardly direction toward paddle wheel 62. As the surplus developer mix descends, it falls through the apertures of paddle wheel 62 into the lower region of developer housing 60.

The developer mix which passes metering blade 74 is carried over transport roll 64 to developer roll 66. The developer mix then advances into development zone 76 located between photoconductive surface 12 and developer roll 66. The electrostatic latent image recorded on photoconductive surface 12 is developed by contacting the moving developer mix 68. The charged areas of photoconductive surface 12 electrostatically attract the toner particles from the carrier granules of developer mix 68. At the exit of development zone 76, the strong magnetic field in a direction generally tangential to developer roll 66 continues to secure thereto the unused developer mix and denuded carrier granules. Thereafter, the unused developer mix and denuded carrier granules enter a region relatively free from magnetic forces and fall from developer roll 66 into the lower region of housing 60. The descending unused developer mix and denuded carrier granules pass through mixing baffle 78 which diverts the flow from the ends toward the center of developer housing 60 to provide mixing in this direction.

Cylindrical shroud 70 serves to control the fall of the unused developer mix and denuded carrier granules such that they mix with the toner particles rather than simply falling into the lower region of housing 60. Furthermore, shroud 70 isolates, from the developer mix, an interior cylindrical enclosure which is used to house cylindrical toner dispenser 80. Dispenser 80 contains a fresh supply of toner 82 which passes through aperture 72 in shroud 70 into the stream of developer mix 68. Toner particles are added at this location to insure that it cannot be carried into development zone 76 without some degree of mixing with the carrier granules. Additional toner particles are furnished to the developer mix in order to replace those used in forming powder images. This maintains the concentration of toner particles within the developer mix substantially constant providing uniform image developability.

Paddle wheel 62 is driven by gear 84 attached thereto. Gear 84 meshes with clutch gear 86. When clutch gear 86 is energized it is driven by a drive motor and, in turn, drives gear 84 attached to paddle wheel 62. In this way, paddle wheel 62 rotates in the direction of arrow 88.

Developer roll 66 includes a tubular member 90 journaled for rotation by suitable means such as ball bearing mounts. A shaft 92 made preferably of steel is concentrically mounted within tubular member 90 and serves as a fixed mounting for magnetic means 94. Magnetic means 94, preferably, comprises magnets made of barium ferrite in the form of annular rings and arranged with five poles on about a 284° arc about shaft 92. Tubular member 90 is coupled electrically to a power supply via suitable slip rings enabling a bias voltage to be applied thereto.

Similarly, transport roll 64 includes a tubular member 96 journaled for rotation by suitable means such as ball bearing mounts. A shaft 98 made preferably, of steel is concentrically mounted within tubular member 96 and functions as a fixed mounting for magnetic means 100. Magnetic means 100, preferably, includes barium ferrite magnets in the form of annular rings arranged with four poles on a 180° arc about shaft 98. It should be noted that actuation clutch gear 86 which in turn, drives gear 84 and paddle wheel 62 also energizes the drive system for transport roll 64 and developer roll 66, respectively. In this way, a drive motor and sprocket chain associated with suitable gearing, rotate tubular members 90 and 96 relative to their respective stationary magnets to advance the developer mix thereon. The detailed structure of tubular member 90 will be described hereinafter with reference to FIG. 3. It should be noted that tubular member 96 is substantially identical thereto and will not be described hereinafter.

While tubular member 90 has been described as rotating relative to a stationarily mounted magnetic means 94, one skilled in the art will appreciate that tubular member 90 may be mounted fixedly with magnetic means 94 rotating relative thereto.

Figure 2:
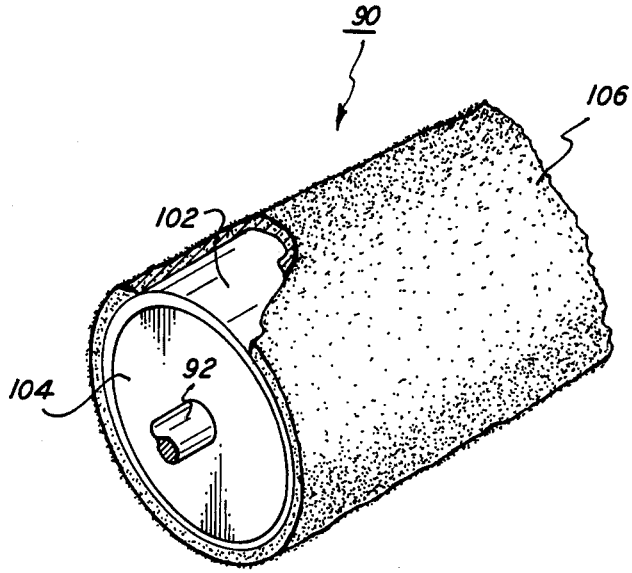
FIG. 2 is a sectional elevational view of the development system employed in the FIG. 1 printing machine.

Referring now to FIG. 2, there is shown a fragmentary perspective view depicting the structure of tubular member 90. As shown therein, tubular member 90 includes a hollow non-magnetic roll 102 made of a non-magnetic metal such as aluminum. A slip ring assembly electrically connects roll 102 to a power supply. In this manner, layer 106 is electrically biased to a selectable voltage level. Alternatively, roll 102 may be made from a phenolic material. Under these circumstances, conductive, e.g. metal, tabs are attached to layer 106. Slip rings electrically connect the tabs of layer 106 to the power supply. This enables layer 106 to be suitably electrically biased. Plates 104 close the ends of roll 102. Shaft 92 extends through plates 104 and provides a fixed mounting for the magnetic annular rings mounted interiorly thereof. A layer 106 of styrene-butadiene having conductive particles dispersed therethrough is coated on the exterior circumferential surface of roll 102. Layer 106 is textured to form cup-like areas which transport the developer mix. Thus, the surface finish of layer 106 must be of a sufficient magnitude to advance frictionally the developer material to the latent image during the rotary movement of tubular member 90. Preferably, the conductive particles dispersed in the styrene-butadiene are carbon black. The resistivity of layer 106 increases in an inverse relationship with the concentration of carbon black therein. Preferably, the resistivity may range from about $10^2$ ohm-centimeters to about $10^8$ ohm-centimeters. Layer 106 has preferably a resistivity of about $10^5$ ohm-centimeters. Layer 106 is applied to roll 102 wither by dip coating or spray coating. By way of example, the styrene-butadiene appropriate for this application is sold under the trademark of Kraton 1101 for 4119 and manufactured by the Shell Chemical Company in Stamford, Connecticut. The dip coating or spray coating process is achieved by forming a solution of styrene-butadiene, carbon black and a solvent, such as toluene. This is achieved by mixing 16.6% of styrene-butadiene by weight with 81% by weight of a solvent such as toluene and allowing the mixture to stand until the solution is formed. Thereafter, the solution is stirred and 2.4% by weight of carbon black is added slowly thereto. Roll 102 may now be dipped into the foregoing solution of styrene-butadiene, toluene, and carbon black to form a coating thereon. Alternately, in the preferred mode, a spray coating may be used. To this end, a Binks model 15 sprayer having a 78 by 78 S-nozzle is filled with the solution and the solution sprayed therefrom onto roll 102. In this manner, a 25 mil thick coating may be sprayed on roll 102 to form layer 106 thereon. Layer 106 will now have a felt-like texture which has a sufficient coefficient of friction to transport the developer mix as tubular member 90 rotates. Preferably, the coefficient of friction will be about 0.80. It should be noted that a plurality of spray or dip coatings may be applied to roll 102 so that layer 106 achieves the requisite thickness. After each coating, the conductive styrene-butadiene layer is air dryed for approximately 15 minutes before an additional coating is applied thereto. Any residual solvent may be removed from layer 106 by placing the resultant assembly, i.e. layer 106 and roll 102, in an oven at about 150° F for about 15 minutes. After drying, the resultant layer 106 coating roll 102 preferably comprises about 87% styrene-butadiene by weight and about 13% carbon black by weight.

A tubular member formed in this fashion will have a hardness of about 85 on a Shore A durometer scale. The volume resistivity of such a tubular member will be about $10^5$ ohm-centimeters. In addition, when spray coated thereon, the outer surface will be textured or felt-like having a sufficient coefficient of friction to advance the developer mix as the tubular member rotates.

From the foregoing it is apparent that the tubular member of both the transport roll and developer roll have a textured resilient surface, i.e. rubber-like, which is conductive. In this manner, the developer roll and transport roll do not wear or work the developer mix and similarly they retain their frictional characteristics for the requisite life, i.e. a minimum of 300 hours of operating time. The conductivity of layer 102 permits an electrical bias to be applied to the developer roll during the development operation.

It is, therefore, evident that there has been provided in accordance with this invention, an apparatus for developing an electrostatic latent image that fully satisfies the objects, aims and advantages hereinbefore set forth. While this invention, has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for depositing a developer material on a surface having a latent image recorded thereon, including:

a tubular member comprising a hollow substantially non-magnetic roll with a layer of styrene-butadiene having conductive particles dispersed therethrough being coated on the exterior circumferential surface of the roll and having a surface finish at least of a magnitude sufficient to transport the developer material to the latent image, the layer coated on the roll of said tubular member preferably having a resistivity ranging from about $10^2$ ohm-centimeters to about $10^8$ ohm-centimeters, and the layer comprising about 87 percent styrene-butadiene by weight and about 13 percent conductive particles by weight; and magnetic means disposed within the roll of said tubular member for creating a magnetic field about at least a portion of the periphery of said tubular member to attract magnetically the developer material to the layer on the roll thereof.

2. An apparatus as recited in claim 1, further including means for producing relative rotation between said magnetic means and said tubular member.

3. An apparatus as recited in claim 2, further including:

a housing defining a chamber for storing the developer material therein; and means for advancing the developer material from the storage chamber of said housing to said tubular member.

4. An apparatus as recited in claim 3, wherein the layer coated on the roll of said tubular member preferably has a resistivity of about $10^5$ ohm-centimeters.

5. An apparatus as recited in claim 4, wherein the conductive particles dispersed in the layer coated on the roll of said tubular member include carbon black.

6. An apparatus as recited in claim 5, wherein the roll of said tubular member is preferably made from a nonmagnetic metal.

7. An apparatus as recited in claim 5, wherein the roll of said tubular member is preferably made from a phenolic material.

8. An electrophotographic printing machine of the type having an electrostatic latent image recorded on a photoconductive member developed with a developer material, wherein the improvement includes:

a tubular member comprising a hollow substantially non-magnetic roll with a layer of styrene-butadiene having conductive particles dispersed therethrough being coated on the exterior circumferential surface of the roll and having a surface finish at least of a magnitude sufficient to transport the developer material to the electrostatic latent image, the layer coated on the roll of said tubular member preferably having a resistivity ranging from about $10^2$ ohm-centimeters to about $10^8$ ohm-centimeters, and the layer comprising about 87 percent styrene-butadiene by weight and about 13 percent conductive particles by weight; and magnetic means disposed within the roll of said tubular member for creating a magnetic field about at least a portion of the periphery of said tubular member to attract magnetically the developer material to the layer on the roll thereof.

9. A printing machine as recited in claim 8, further including means for producing relative rotation between said magnetic means and said tubular member.

10. A printing machine as recited in claim 9, further including:

a housing defining a chamber for storing the developer material therein; and means for advancing the developer material from the storage chamber of said housing to said tubular member.

11. A printing machine as recited in claim 10, wherein the layer coated on the roll of said tubular member preferably has a resistivity of about $10^5$ ohm-centimeters.

12. A printing machine as recited in claim 11, wherein the conductive particles dispersed in the layer coated on the roll of said tubular member include carbon black.

13. A printing machine as recited in claim 12, wherein the roll of said tubular member is preferably made from a nonmagnetic metal.

14. A printing machine as recited in claim 12, wherein the roll of said tubular member is preferably made from a phenolic material.

* * * * *